United States Patent [19]

Johnson et al.

[11] Patent Number: 4,736,944

[45] Date of Patent: Apr. 12, 1988

[54] EXERCISE ROWING MACHINE FRAME STRUCTURE

[75] Inventors: Jeffrey B. Johnson, Bellevue; Allan F. Strickland, Bothell; Daniel R. Moon, Seattle, all of Wash.

[73] Assignee: M & R Industries, Inc., Redmond, Wash.

[21] Appl. No.: 917,179

[22] Filed: Oct. 9, 1986

[51] Int. Cl.[4] ..... A63B 21/00; A63B 69/06

[52] U.S. Cl. ..... 272/72; 272/130

[58] Field of Search ..... 272/69, 70, 72, 130

[56] References Cited

U.S. PATENT DOCUMENTS 2,183,345 12/1939 Brandon ..... 272/72

4,618,140 10/1986 Brown ..... 272/72

FOREIGN PATENT DOCUMENTS 1024084 6/1983 U.S.S.R. ..... 272/72

*Primary Examiner*—Richard J. Apley

*Assistant Examiner*—S. R. Crow

*Attorney, Agent, or Firm*—Seed and Berry

[57] ABSTRACT

An exercise rowing machine has a frame structure with a center track rail, front and rear cross-members supporting the track rail, and a U-frame connected to the track rail and the front cross-member. The front cross-member is a one-piece molded part providing a seat for the track rail, saddles for a pivot shaft for foot plates, clevises for pivotal connection to hydraulic cylinder units which are pivotally connected to rowing arms in turn pivotally connected to the U-frame, sockets for receiving the U-frame, and supports for front transport wheels.

11 Claims, 4 Drawing Sheets

FIG. 2
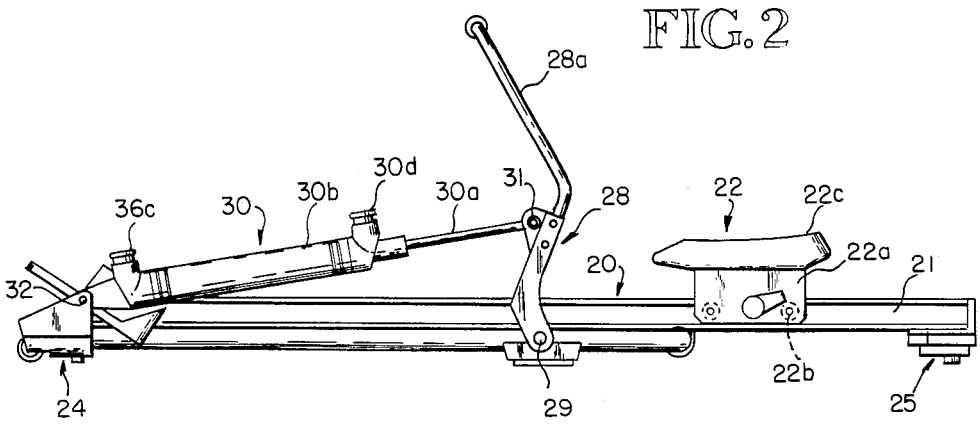
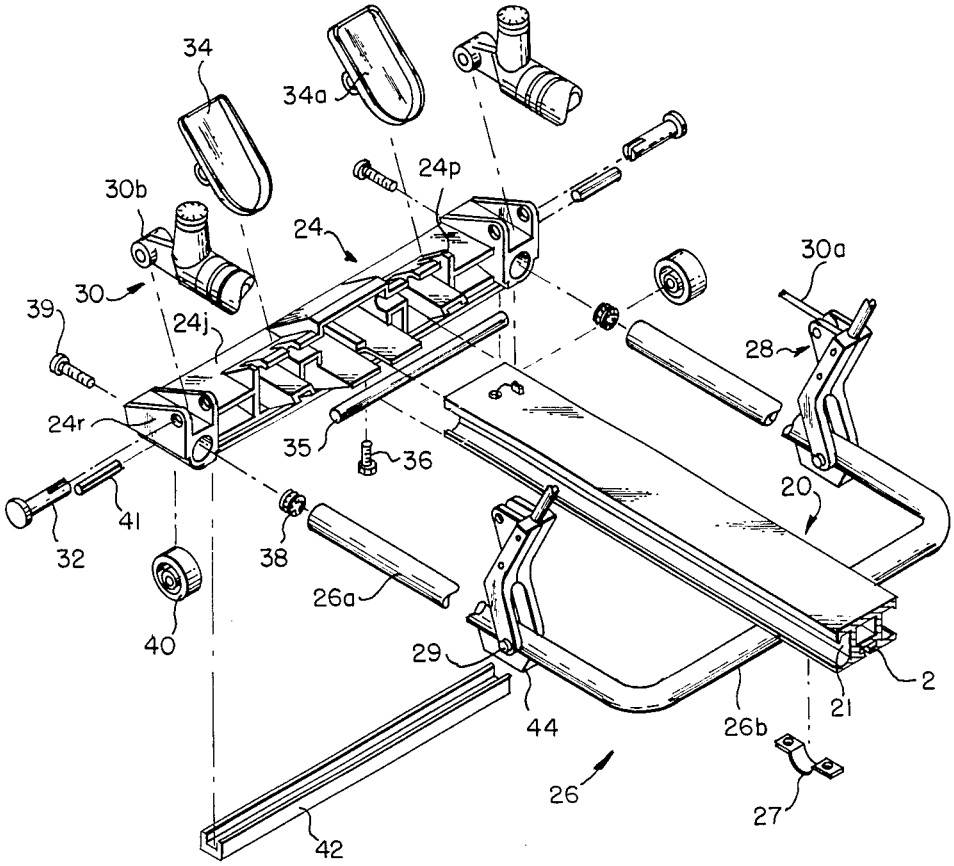
FIG. 3

EXERCISE ROWING MACHINE FRAME STRUCTURE

TECHNICAL FIELD

The present invention relates to exercise rowing machines of the type shown in U.S. Pat. No. 4,541,627 and more particularly to an improved frame structure for such a rowing machine.

BACKGROUND OF THE INVENTION

Twisting forces of considerable magnitude may be created during use of an exercise rowing machine which tend to wrack the frame structure. These forces are created in large part by unequal pressures applied from side to side to the foot pedals and to the rowing arms. The frame arrangement shown in U.S. Pat. No. 4,541,627 has been very satisfactory and competitive in the marketplace, but further progress is always in order.

DISCLOSURE OF THE INVENTION

Accordingly, the present invention aims to provide an improved frame structure for a rowing machine which is of unusually durable construction and yet can be easily assembled without welding and takes advantages of the economies of plastic molding techniques.

In carrying out the present invention there is provided novel front and rear plastic cross-frame members which are adapted to be injection molded without requiring complicated molding techniques and which cooperate with a center extruded-aluminum rail member and a U-shaped tubular frame member of the type used in the rowing machine disclosed in U.S. Pat. No. 4,541,627 in a manner preserving the economies of that structure and adding an improved overall arrangement for the foot plate pivotal mounting and the front connections of the center rail, U-frame member and the hydraulic cylinder units. The one-piece durable front cross-member provides a seat for the center rail, saddles for receiving a single pivot shaft for the foot plates which is retained by the forward end of the center rail, clevises for pivotal connection to the hydraulic cylinder units, sockets for receiving the legs of the U-shaped frame unit, and supports for front transport wheels.

BRIEF DESCRIPTION OF THE DRAWINGS

FIG. 2 is a side elevation of the rowing machine.

FIG. 3 is an exploded view of a major portion of the machine.

BEST MODE FOR CARRYING OUT THE INVENTION

Figure 1:
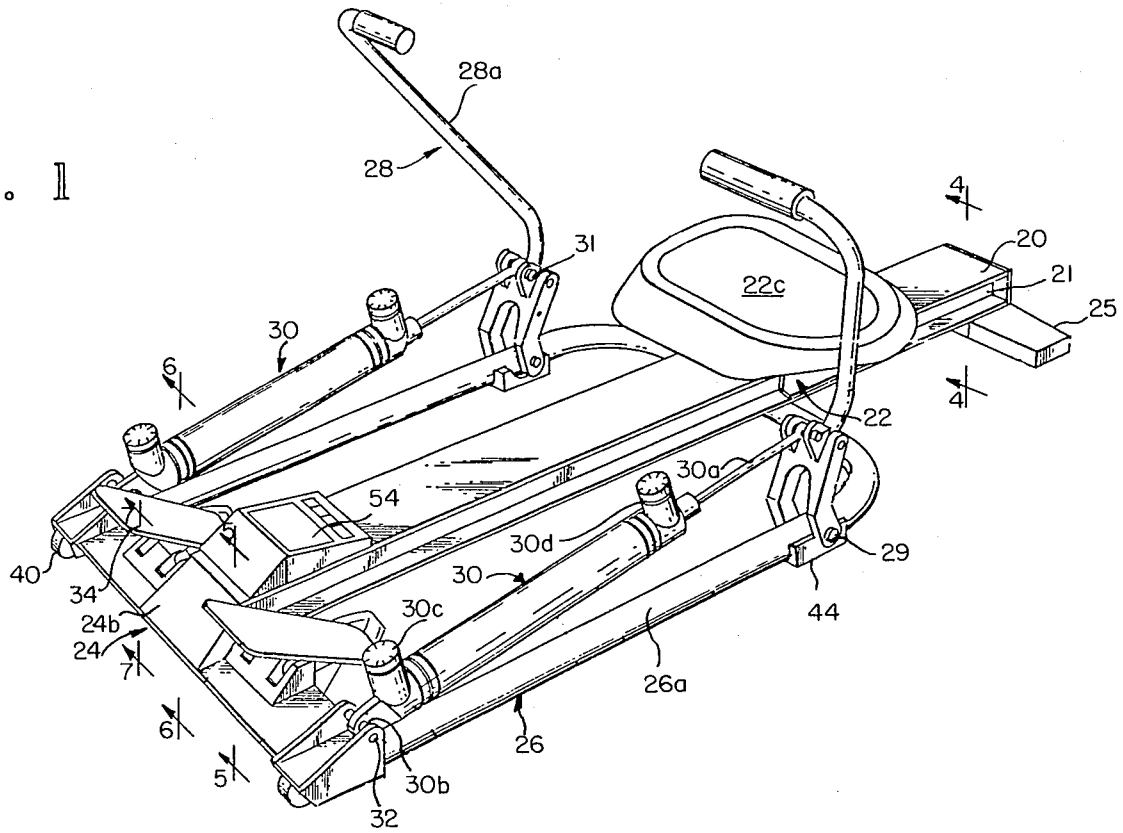
FIG. 1 is a perspective view of a rowing machine made in accordance with the present invention.

The exercise rowing machine of the present invention utilizes a tubular center rail 20 like that shown in U.S. Pat. No. 4,541,627, and namely one of generally rectangular shape providing a pair of side channels 21 and a bottom T-slot 22. As shown in such patent, a seat carriage 22 has an inverted U-frame 22*a* which straddles the center rail 20 and has a pair of rollers 22*b* at each side riding in the side channels 21. A resilient seat unit 22*c* is screw-mounted on the U-frame 22*a*.

At the front the center rail 20 is mounted on a front cross-member 24 and at the rear is mounted on a rear cross-member 25. In a manner to be later described, a U-shaped tubular frame unit 26 has a pair of legs 26*a* connected to the front cross-member 24 and has a central section 26*b* connected to the underside of the center rail 20 by a U-clip 27 with bolts having their heads retained in the T-slot 22.

A pair of arm assemblies 28 are pivotally mounted on the tubular legs 26*a* by pins 29, and a pair of double-acting load-resisting hydraulic cylinder units 30 have their piston rods 30*a* pivotally connected by pins 31 to the arm assemblies 28 and have front end blocks formed with eyes 30*b* pivotally connected by pins 32 to the front cross-member 24. The hydraulic cylinder units 30 are preferably ones having an adjustable resistance to flow from each side of a double-acting piston therein which is varied by turning knobs 30*c*, 30*d*. *At the front of the machine there are a pair of foot pedals 34 each with a pair of depending ears 34a* through which a pivot shaft 35 extends.

Directing attention to the front cross-member 24, such is a one-piece molded plastic part having a rearwardly facing central socket 24*a* with a sloped forward wall 24*b* and a bottom wall which projects rearwardly as a central ledge 24*c* to support the forward end portion of the central rail 20. The ledge 24*c* has a central slot 24*d* and central key 24*e* which extends into the forward end of the T-slot 22 at the bottom of the rail 20. A bolt 36 is retained by the T-slot and has its nut engaging the bottom of ledge 24*c*.

Figure 6:
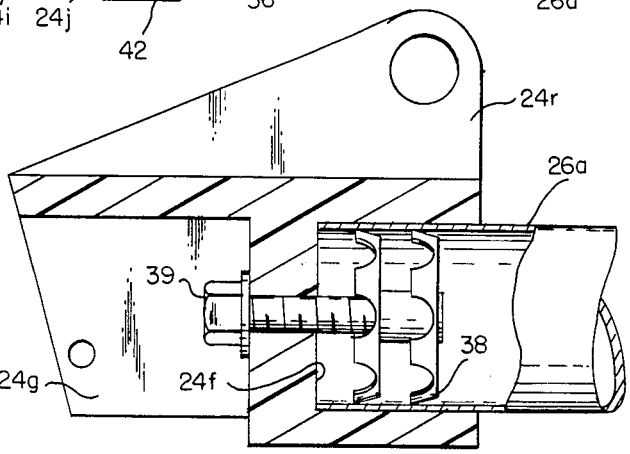

At each of its ends the front cross-member 24 has a pair of clevis ears 24*r* for receiving the pins 32 connecting the cylinder units to the front cross-member 30*b* and has a pair of rearwardly exposed circular sockets 24*f* for receiving the forward ends of the tubular legs 26*a*. As shown in FIG. 6, each leg 26*a* is fitted with a gripping unit 38 which threadably receives a bolt 39 passing through an opening in the forward wall of the respective socket 24*f* so as to secure the legs 26*a* to the front cross-member 24. Forwardly of the sockets 24*f* the cross-member has a recess at each end with outer and inner walls 24*g*, 24*h* for receiving a pair of front transport rollers 40 which are journaled on pins 41 extending through aligned holes in the walls 24*g*, 24*h*.

Figure 5:
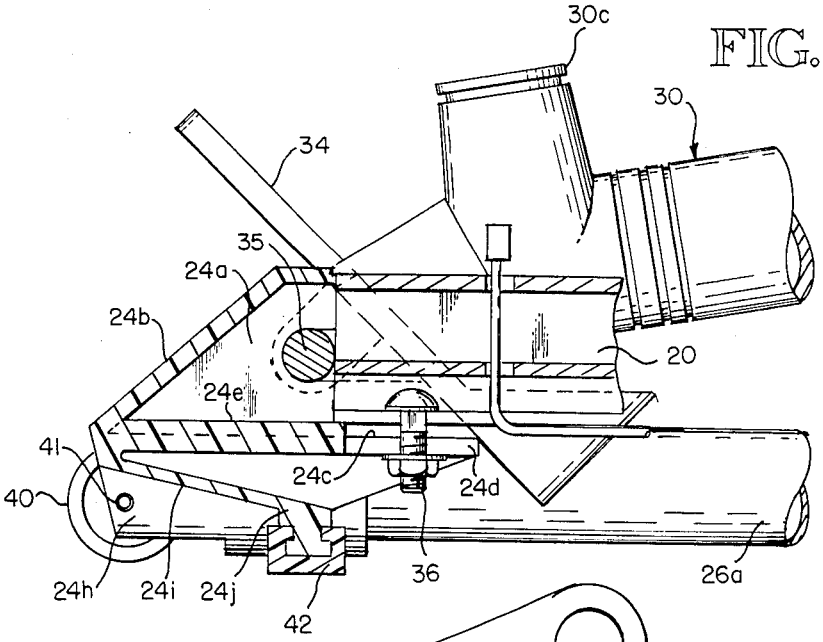

Between the walls 24*h* the front cross-member has a sloped bottom wall 24*i* formed with a bottom rear ridge 24*j* which has a pair of retaining grooves therealong for holding a front skid strip 42 of rubber-like material, as shown in FIG. 5. To save weight, the back of the front cross-member has a series of rearwardly facing recesses between the end sockets 24*f* and the central ledge 24*c* between the sloped bottom wall 24*i* and an upper wall 24*j* which intersects the bottom wall 24*i* at an acute dihedral angle at the front.

Figure 7:
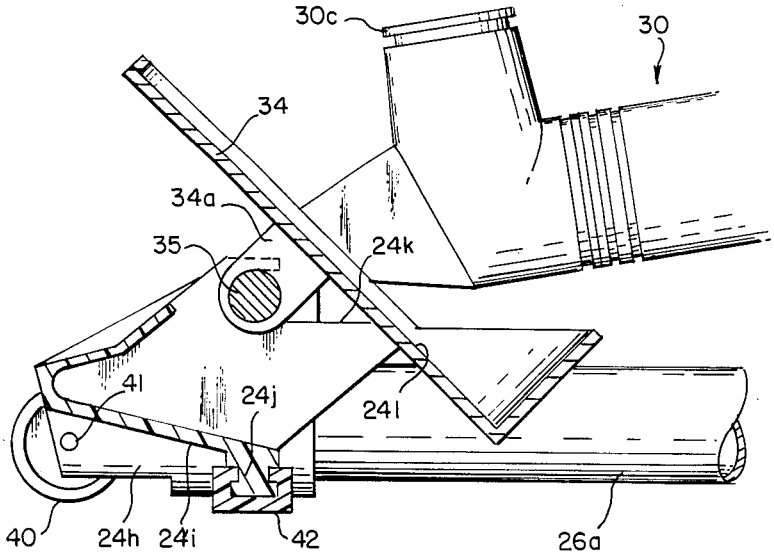

About midway between the central ledge 24*c* and the end sockets 24*f*, the front cross-member 24 is formed with a pair of rearwardly projecting stop ledges 24*k* with sloped rear stop edges 24*l* for limiting downward swinging of the foot plates 34, as shown in FIG. 7. The mounting ears 34*a* on the underside of the foot plates 34 straddle outer hook flanges 24*m* directly above the forward end of the stop ledges 24*k*. These outer hook flanges 24*m* align with inner hook flanges 24*n* which join the lateral side walls of the central recess 24*a*. The pairs of outer and inner hook flanges 24*m* and 24*n* provide semicircular saddles which receive the pivot shaft 35 for the mounting ears 34*a* of the foot plates 34. Endwise movement of the shaft 35 is prevented by upwardly projecting retaining walls 24*p* (FIG. 3). The pivot shaft 35 is retained within the hook flanges 24*m*, 24*n* by the forward end of the central rail 20, as best shown in FIG. 5.

Figure 4:
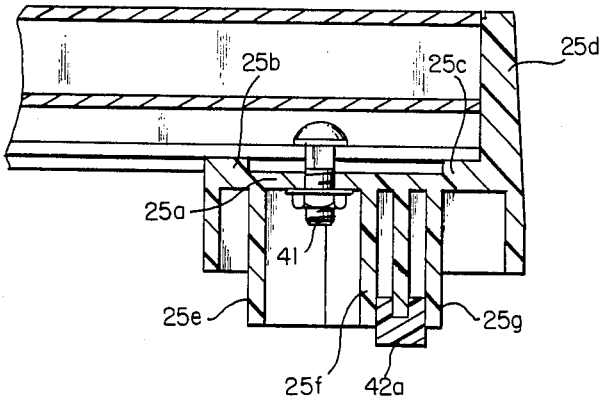
FIGS. 4, 5, 6 and 7 are sectional views taken as indicated by lines 4—4, 5—5, 6—6 and 7—7 in FIG. 1.

The rear cross-member 25 is preferably of one-piece molded plastic construction and, as shown in FIG. 4, has an upper support wall 25*a* with a pair of integral keys 25*b*, 25*c* fitting into the T-slot 22. At the back, the cross-member 25 has a rear upstanding closure wall 25*d* covering the rear open end of the central rail 20. A central bolt 41 retained by the T-slot 22 extends through the support wall 25*a* to receive a nut between depending leg flanges 25*e*, 25*f*. Crowded between the leg flange 25*f* and a third leg flange 25*g* is a channel-shaped anti-skid strip 42*a* of rubber-like material which fits over a shorter flange 25*h* located midway between leg flanges 25*f*, 25*g*.

Figure 8:
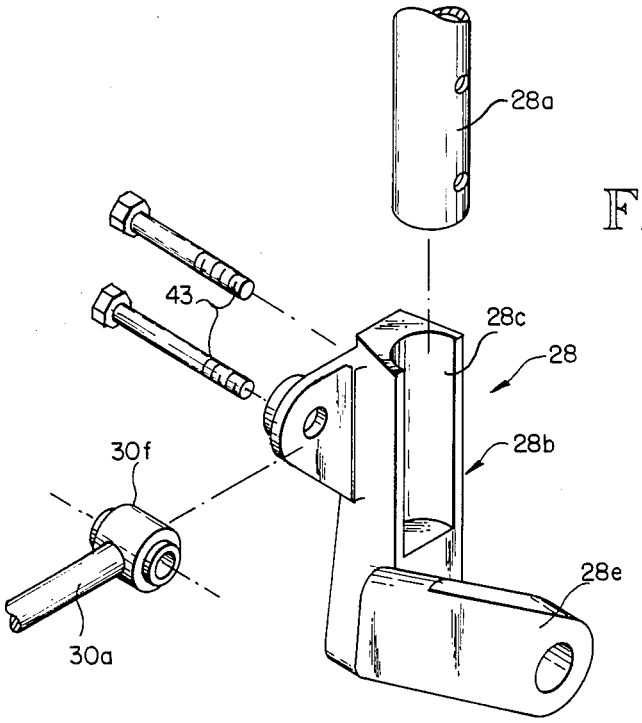
FIG. 8 is an exploded view of part of the assembly at the lower ends of the rowing arms.

Referring to FIG. 8, each arm assembly 28 has a tubular arm 28*a* bent at its upper end for a handle grip and a two-piece end fitting with complementing shells 28*b* which are mirror images of one another. These shells are held together and secured together by a pair of bolts 43 passing through the shells and the rowing arms 28*a* at the location of a socket 28*c* formed jointly by the shells 28*b*. The shells each have a clevis ear 28*d* for receiving the pivot pin 31 passing through a bearing unit 30*f* at the free end of the respective piston rod 30*a*. Each shell 28 also has a fork arm 28*e* to receive one of the pivot pins 29 connecting the rowing arm assemblies to the legs 26*a* of the tubular U-frame 26.

The rowing machine may be provided with a readout housing 54 mounted on the center rail for providing data computed from inputs corresponding to the settings of the knobs 30*c*, 30*d* of the hydraulic cylinder units 30 and input from emitter/receiver circuits interrupted by choppers in foot housings 44 at the underside of the legs 26*a* adjacent the pivot pins 29. The choppers are mounted at the lower end of the arm assemblies 28 to swing therewith. Wiring from the foot housings 44 passes through the U-shaped unit 26 and the center rail 20 to a microprocessor in the readout housing 54.

It will be apparent that the described rowing machine can be easily assembled and provides an unusally strong and durable frame structure. The location of the wheels 40 is such that they are raised out of ground contact during normal use of the machine, but can be brought into ground contact by raising the rear cross-member 25, whereupon the machine can be easily wheeled to another site.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. In an exercise rowing machine:

an elongated center rail member having front and rear ends and being formed along its underside with a T-slot having a leg portion exposed at its lower end and a cross-arm portion at the top of the leg portion;

a one-piece front cross-member having a rearwardly facing central socket and a rearwardly projecting central ledge continuing from the bottom face of the central socket, said central ledge having a central opening therethrough, a forward end portion of said rail member resting on said ledge and extending into said central socket with its T-slot registering with said central opening;

a one-piece rear cross-member providing an upper central support wall having a central hole therethrough and providing an upstanding rear wall at the back of said central support wall; a rear end portion of said rail member resting on said central support wall with said upstanding rear wall covering the rear end of the rail member and said central hole registering with said T-slot;

front and rear bolts in said T-slot, each having an enlarged head confined in the cross-arm portion of the T-slot and having a shank extending through the leg portion of the slot, the front bolt shank extending downwardly through said central opening in the ledge and the rear bolt shank extending downwardly through said central hole in said central support wall, and said front and rear bolts having nuts threaded onto their shanks and bearing against the undersides of said ledge and central support wall; and a seat carriage slidably mounted on said rail member for travel between said front and rear cross-members.

2. In an exercise rowing machine according to claim 1, said rear cross-member having an integral key extending upwardly into the leg portion of said T-slot with said leg portion serving as a keyway.

3. In an exercise rowing machine according to claim 1, said front and rear cross-members each having an integral key extending upwardly into the leg portion of said T-slot with said leg portion serving as a keyway.

4. In an exercise rowing machine according to claim 1, in which said front cross-member has a bottom ridge between said end sockets with grooves therealong to interfit with a flexible anti-skid strip.

5. In an exercise rowing machine, an elongated, front cross-member having front and rear sides, said front cross-member being formed integrally with:

a rearwardly facing center support ledge for receiving the forward end of a longitudinal center rail adapted to have a seat carriage roll therealong;

a pair of end sockets near the ends of the cross-member for receiving the forward ends of a U-shaped frame member connected to the center rail;

a pair of clevises directly above said end sockets for pivotally receiving a pair of cylinder units connected to the U-shaped frame member; and a pair of rearwardly facing saddles positioned between said center support ledge and said end sockets for receiving a shaft extending along said cross-member from said saddles forwardly of said center support ledge for pivotally mounting a pair of foot plates at opposite sides of the center rail, with the forward end of the center rail retaining said shaft in said saddles.

6. In an exercise rowing machine according to claim 5, in which said center support ledge has an opening therethrough for receiving a fastener depending from the center rail.

7. In an exercise rowing machine according to claim 5, in which said front cross-member also has integral stop walls located between said pair of saddles and said pair of clevises for giving endwise confinement to a shaft occupying said pair of saddles.

8. In an exercise rowing machine according to claim 5, in which said front cross-member also has integral stop flanges projecting rearwardly below said pair of saddles to limit downward movement of a pair of foot pedals pivotally mounted on a shaft received in said pair of saddles.

9. In an exercise rowing machine according to claim 5, in which said front cross-member provides a second pair of saddles aligned with said first-mentioned pair of saddles and located between the latter and said center support ledge.

10. In an exercise rowing machine according to claim 9, in which said front cross-member also has integral stop walls located between said first-mentioned pair of saddles and said pair of clevises for giving endwise confinement to a shaft occupying said pairs of saddles, said first-mentioned pair of saddles being spaced from said stop walls and said second pair of recesses by gaps.

11. In an exercise rowing machine according to claim 5, in which said front cross-member has spaced side supports for receiving a transport wheel shaft directly forward of said sockets.

* * * * *